US011371506B2

(12) United States Patent
Hoshino et al.

(10) Patent No.: US 11,371,506 B2
(45) Date of Patent: Jun. 28, 2022

(54) ROTARY COMPRESSOR

(71) Applicant: FUJITSU GENERAL LIMITED, Kanagawa (JP)

(72) Inventors: Shuhei Hoshino, Kanagawa (JP); Naoya Morozumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 15/734,407

(22) PCT Filed: Jul. 3, 2019

(86) PCT No.: PCT/JP2019/026486
§ 371 (c)(1),
(2) Date: Dec. 2, 2020

(87) PCT Pub. No.: WO2020/013055
PCT Pub. Date: Jan. 16, 2020

(65) Prior Publication Data

US 2021/0164472 A1 Jun. 3, 2021

(30) Foreign Application Priority Data

Jul. 10, 2018 (JP) ..... JP2018-130860

(51) Int. Cl.
*F03C 2/00* (2006.01)
*F03C 4/00* (2006.01)
(Continued)

(52) U.S. Cl.
CPC ..... *F04C 29/023* (2013.01); *F04C 18/356* (2013.01); *F04C 18/3564* (2013.01);
(Continued)

(58) Field of Classification Search
CPC .. F04C 18/356; F04C 18/3564; F04C 23/008; F04C 29/0057; F04C 29/02; F04C 29/023; F04C 2240/809
See application file for complete search history.

(56) References Cited

U.S. PATENT DOCUMENTS 4,472,114 A * 9/1984 Fujiwara ..... F04B 7/06 417/372
4,828,466 A * 5/1989 Kim ..... F04C 29/023 418/94
(Continued)

FOREIGN PATENT DOCUMENTS

CN 1548766 A 11/2004
CN 205858673 U 1/2017
(Continued)

OTHER PUBLICATIONS

JP63235686 A—SANO—Two Cylinder Revolution Type Sealed Type Motor-Driven Compressor—Sep. 30, 1988—Machine English Translation. (Year: 1988).*
(Continued)

*Primary Examiner* — Theresa Trieu
(74) *Attorney, Agent, or Firm* — Paratus Law Group, PLLC

(57) ABSTRACT

In a vertical cylindrical hermetically sealed container, a rotary compressor includes a motor unit and a compression unit below the motor unit. The compression unit includes a shaft having an eccentric portion, a piston shaped to fit into the eccentric portion, a flat plate-shaped vane pressed against an outer circumferential surface of the piston, and a cylinder that accommodates the piston and the vane and forms a suction chamber and a compression chamber. The rotary compressor stores, in the hermetically sealed container, lubricating oil of which amount causes immersion of a part of the compression unit. The rotary compressor has a
(Continued)

hollow portion on a lower end side of the shaft, and has an oil supply diagonal hole that is inclined with respect to a rotation axis of the shaft and causes the hollow portion and an upper end of the eccentric portion to communicate with each other.

2 Claims, 7 Drawing Sheets

(51) Int. Cl.

| | |
|---|---|
| ***F04C 2/00*** | (2006.01) |
| ***F04C 29/02*** | (2006.01) |
| ***F04C 18/356*** | (2006.01) |
| ***F04C 29/00*** | (2006.01) |
| ***F04C 23/00*** | (2006.01) |

(52) U.S. Cl.
CPC ..... *F04C 23/008* (2013.01); *F04C 29/0057* (2013.01); *F04C 29/02* (2013.01); *F04C 2240/809* (2013.01)

(56) References Cited

U.S. PATENT DOCUMENTS

| | | | | |
|---|---|---|---|---|
| 2005/0053506 | A1* | 3/2005 | Cho | F04C 29/023 418/94 |
| 2010/0180628 | A1* | 7/2010 | Hasegawa | F04C 29/023 418/83 |
| 2012/0134864 | A1 | 5/2012 | Lee et al. | |

FOREIGN PATENT DOCUMENTS

| | | | | | |
|---|---|---|---|---|---|
| JP | S63-235686 | A | | 9/1988 | |
| JP | 02140488 | A | * | 5/1990 | F04C 29/023 |
| JP | 2016-145528 | A | | 8/2016 | |
| KR | 10-2011-0015850 | A | | 2/2011 | |

OTHER PUBLICATIONS

Dec. 24, 2021, Chinese Office Action issued for related CN Application No. 201980037338.5.

* cited by examiner

ROTARY COMPRESSOR

CROSS REFERENCE TO PRIOR APPLICATION

This application is a National Stage Patent Application of PCT International Patent Application No. PCT/JP2019/026486 (filed on Jul. 3, 2019) under 35 U.S.C. § 371, which claims priority to Japanese Patent Application No. 2018-130860 (filed on Jul. 10, 2018), which are all hereby incorporated by reference in their entirety.

FIELD

The present invention relates to a rotary compressor.

BACKGROUND

A rotary compressor is known, which includes: a motor unit in an upper portion of an inside of a vertical cylindrical hermetically sealed container; and a compression unit in a lower portion thereof.

The motor unit includes a stator and a rotor, and rotates the rotor by generating a rotating magnetic field in the stator. An amount of refrigerant circulation can be varied by changing a rotation speed of the motor.

An upper portion of a shaft is fixed to the rotor, and a lower portion thereof penetrates the compression unit and is rotatably supported by a main bearing provided on an upper side of the compression unit and an auxiliary bearing provided on a lower side thereof. The shaft is provided with an eccentric portion at a position of the compression unit. The eccentric portion is a disk-shaped region that protrudes in one direction in a direction perpendicular to the shaft.

A piston is provided inside a cylinder that constitutes the compression unit, and the piston is fitted to the eccentric portion of the shaft. Further, the inside of the cylinder is provided with a flat plate-shaped vane, which is pressed against an outer circumferential surface of the piston, and the vane divides a space, which is formed of an inner circumferential surface of the cylinder and the outer circumferential surface of the piston, into a suction chamber and a compression chamber.

An upper end plate and a lower end plate, which close upper ends and lower ends of the suction chamber and the compression chamber, respectively, are provided on upper and lower ends of the cylinder, and constitute the compression unit. The main bearing and the auxiliary bearing, which support the shaft, are integrally provided on the upper end plate and the lower end plate, respectively.

When the rotor and the shaft are rotated, the piston fitted to the eccentric portion of the shaft revolves so that an outer wall of the eccentric portion goes along an inner wall of the cylinder, and the suction chamber and the compression chamber move in the cylinder while changing volumes thereof, and thereby compress and transport a refrigerant gas. The refrigerant gas is sucked into the compression unit from a refrigeration cycle through a suction pipe that penetrates a side surface of the hermetically sealed container, is discharged into the hermetically sealed container after being compressed by the compression unit, and is discharged from a discharge pipe that penetrates an upper end of the hermetically sealed container.

In the rotary compressor, in general, lubricating oil is sealed in order to lubricate inner circumferential surfaces of the above-described main bearing, auxiliary bearing and piston, which are sliding portions, and to seal minute gaps between a plurality of parts which form the suction chamber and the compression chamber.

The shaft is provided with a hollow portion coupled to the main bearing from a lower end thereof, and is further provided with a plurality of horizontal holes which cause the hollow portion and the outside of the shaft to communicate with each other. Centrifugal force acts on the lubricating oil, which is filled in the horizontal holes, by the rotation of the shaft, so that the lubricating oil is supplied to regions which require the lubricating oil. A plate-shaped member having a twisted shape is inserted as an oil supply blade into a hollow portion of the shaft, which is the hollow portion provided on the shaft, and plays a role of promoting an oil supply effect by the centrifugal force. Further, a spiral groove is provided on the inner circumferential surface of the main bearing, and plays a role of a viscosity pump that pulls up the lubricating oil, which is supplied to a lower end of the main bearing, to an upper end of the main bearing. In addition, the lubricating oil may foam in the hollow portion of the shaft due to a stirring action, and the refrigerant dissolved in the lubricating oil may vaporize. However, in order to remove the vaporized refrigerant gas from the hollow portion of the shaft, the shaft is provided with a gas vent hole that causes the hollow portion and the upper end of the shaft to communicate with each other.

CITATION LIST

Patent Literature

Patent Literature 1: JP 2016-145528 A

SUMMARY

Technical Problem

In the rotary compressor, a part of the lubricating oil is atomized inside the hermetically sealed container by being involved in a flow of the refrigerant, and is discharged to the outside of the compressor together with the refrigerant. The discharged lubricating oil circulates in a refrigeration circuit and returns to the compressor, and a constant amount of the lubricating oil inside the compressor is substantially maintained.

However, there is the following problem. In a transitional period when the rotation speed changes, such as when the compressor is started or immediately after the rotation speed of the motor increases, an amount of the discharged oil becomes greater than an amount of the returned oil, the amount of lubricating oil in the compressor temporarily decreases, in particular, it becomes impossible to supply the oil to the horizontal holes provided on an upper portion among the horizontal holes which communicate with the hollow portion of the shaft, and lubrication of the bearings and oil seals of gaps on upper and lower end surfaces of the piston become insufficient.

Further, a part of the lubricating oil, which is discharged from the horizontal holes of the shaft to the outside of the shaft and seals the upper and lower end surfaces of the piston, leaks from the gaps on the upper and lower end surfaces of the piston and flows into the suction chamber having low pressure. Therefore, in order to fill the space outside the eccentric portion of the shaft with the lubricating oil, it is necessary to supply a larger amount of the lubricating oil than an amount of the lubricating oil, which leaks to the suction chamber, from the hollow portion of the shaft through the horizontal holes of the shaft. However, in a compressor that operates in a state in which the pressure in the suction chamber is low, there is the following problem. The amount of oil that leaks into the suction chamber increases, and the space outside the eccentric portion of the shaft cannot be filled with the lubricating oil, resulting in that the oil seals on the gaps of the upper and lower end surfaces of the piston cannot be formed.

Further, the gaps on the upper and lower end surfaces of the piston turn to a state of being hermetically sealed with the lubricating oil. This state is called the oil seals. There is known a method in which, in order to strengthen the oil seals on the gaps of the upper and lower end surfaces of the piston, a horizontal hole that communicates with a hollow portion on a shaft lower end side that is a lower end of the shaft is provided in an eccentric direction of the eccentric portion of the shaft, a vertical hole that communicates with this horizontal hole is provided in the eccentric portion of the shaft, and the oil supply to the upper and lower end surfaces of the piston is increased (JP 2016-145528 A). However, this method has a problem that, if an oil level in the hollow portion of the shaft is lower than that of the horizontal hole in the eccentric portion of the shaft, the horizontal hole cannot be supplied with the oil. Further, there is a problem, that processing man-hours must be increased in order to provide the horizontal hole and the vertical hole in the eccentric portion of the shaft, resulting in an increase in cost.

Further, in order to solve the above-mentioned shortage of the oil supply, there is a method of increasing the amount, of lubricating oil stored in the compressor, but there is a problem that the method leads to an increase in cost.

Solution to Problem

The present invention is characterized in that an oil supply diagonal hole is provided, which passes diagonally upward from the hollow portion of the shaft through a wall surface and eccentric portion of the shaft and penetrates an upper end surface of the eccentric portion of the shaft.

A rotary compressor disclosed in this application, according to an aspect, includes a vertical cylindrical hermetically sealed container; a motor unit and a compression unit which are provided inside the vertical cylindrical hermetically sealed container, the compression unit being disposed below the motor unit; and lubricating oil of which amount causes immersion of a part of the compression unit is stored in the hermetically sealed container, wherein the compression unit includes a shaft having an eccentric portion, a piston shaped to fit into the eccentric portion, a flat plate-shaped vane pressed against an outer circumferential surface of the piston, and a cylinder that accommodates the piston and the vane and forms a suction chamber and a compression chamber, and wherein a hollow portion is provided on a lower end side of the shaft, and the shaft has an oil supply diagonal hole that is inclined with respect to a rotation axis of the shaft and causes the hollow portion and an upper end of the eccentric portion to communicate with each other.

Advantageous Effects of Invention

The sealing by the lubricating oil is surely performed while suppressing the increase in cost, so that degradation of reliability of the compressor and degradation of performance thereof can be prevented.

DESCRIPTION OF EMBODIMENTS

Figure 1:
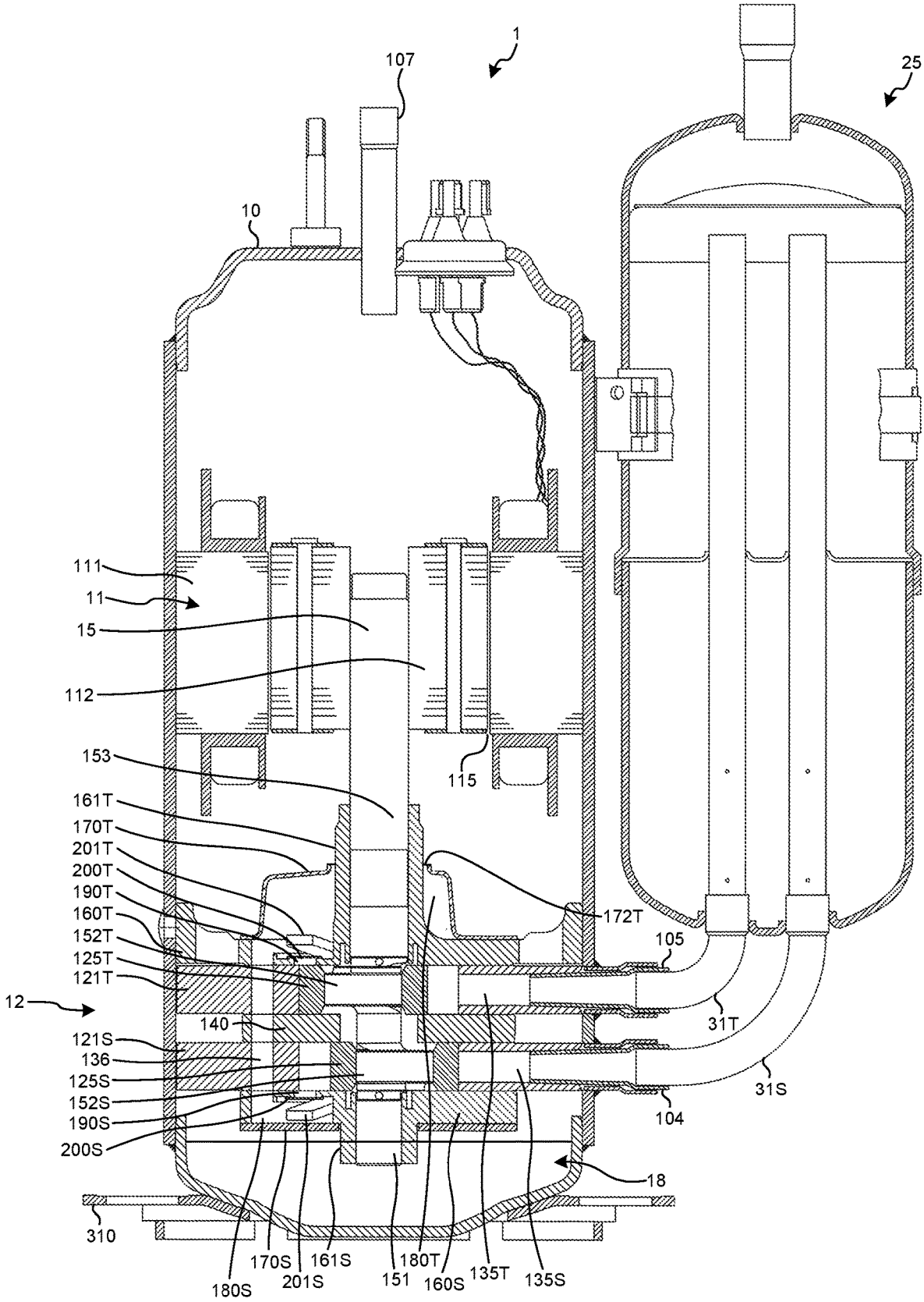
FIG. 1 is a longitudinal sectional view of a rotary compressor according to the present invention.

Referring to the drawings, a detailed description will be given below of embodiments of a rotary compressor disclosed by the present application. Note that the rotary compressor disclosed by the present application is not limited by the following embodiments. Further, in the following description, the same reference numerals are assigned to the same constituents, and a duplicate description thereof will be omitted.

First Embodiment

Figure 2:
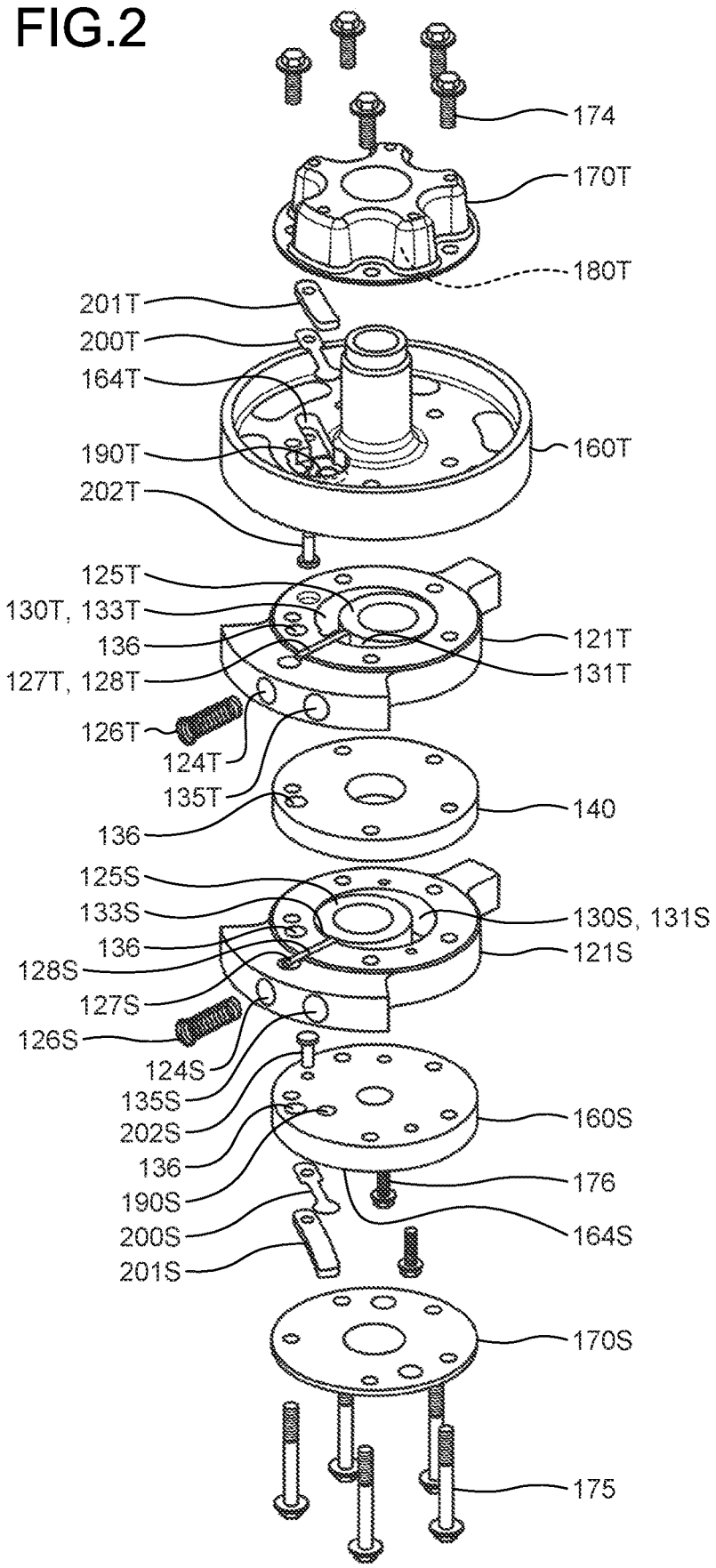
FIG. 2 is an upper portion exploded perspective view illustrating a compression unit of a rotary compressor of a first embodiment.

FIG. 1 is a longitudinal sectional view illustrating a rotary compressor according to the present invention. FIG. 2 is an upper portion exploded perspective view illustrating a compression unit of a rotary compressor of a first embodiment. The following description is given on the premise that an upward orientation when facing FIG. 1, that is, a direction toward a discharge pipe 107 from a compression unit 12 to be described later is defined as an upward direction, and an orientation opposite thereto is defined as a downward direction.

As illustrated in FIG. 1, a rotary compressor 1 includes a motor unit 11 and a compression unit 12, which are disposed in a vertical cylindrical compressor housing 10 that is hermetically sealed. The compression unit 12 is disposed below the motor unit 11. Further, the motor unit 11 drives the compression unit 12 via a shaft 15. Further, the rotary compressor 1 includes a cylindrical accumulator 25 fixed to a side portion of the compressor housing 10.

The accumulator 25 is connected to an upper suction chamber 131T of an upper cylinder 121T via an upper suction pipe 105 and an accumulator upper curved pipe 31T, and is connected to a lower suction chamber 131S (see FIG. 2) of a lower cylinder 121S via a lower suction pipe 104 and an accumulator lower curved pipe 31S.

The motor unit 11 includes: a stator 111 disposed on an outside thereof; and a rotor 112 disposed in an inside thereof. The stator 111 is fixed to an inner circumferential surface of the compressor housing 10 by shrink fitting. The shaft 15 is fixed to the rotor 112 by shrink fitting.

The shaft 15 has two disc-shaped eccentric portions which protrude in one direction perpendicular to the shaft 15. The eccentric portion located in the vicinity of an auxiliary bearing portion 161S disposed on a lower portion of the shaft 15 is a lower eccentric portion 152S, and the eccentric portion located in the vicinity of a main bearing portion 161T disposed on an upper portion of the shaft 15 is an upper eccentric portion 152T. The shaft 15 is supported in such a manner that an auxiliary shaft portion 151 located below the lower eccentric portion 152S is rotatably fitted to the auxiliary bearing portion 161S provided on a lower end plate 160S. Further, the shaft 15 is supported in such a manner that a main shaft portion 153 located above the upper eccentric portion 152T is rotatably fitted to the main bearing portion 161T provided on an upper end plate 160T. The upper eccentric portion 152T and the lower eccentric portion 152S are provided on the shaft 15 with a phase difference of 180 degrees from each other. That is, the upper eccentric portion 152T and the lower eccentric portion 152S are disks which protrude in directions opposite to each other with respect to the shaft 15. Then, an upper piston 125T is supported by the upper eccentric portion 152T, and a lower piston 125S is supported by the lower eccentric portion 152S. Thus, the shaft 15 is supported so as to be rotatable in the fixed compression unit 12, and by rotation thereof, causes the upper piston 125T to revolve along an inner circumferential surface of the upper cylinder 121T, and causes the lower piston 125S to revolve along an inner circumferential surface of the lower cylinder 121S.

Inside the compressor housing 10, lubricating oil 18 of which amount causes immersion of a part of the compression unit 12 is stored. Here, since FIG. 1 is a view for explaining an overall configuration of the rotary compressor 1, illustration of an exact position of an oil level is omitted. To a lower side of the compressor housing 10, mounting legs 310 are fixed, which lock a plurality of elastic support members (not illustrated) which support the entire rotary compressor 1.

As illustrated in FIG. 2, the compression unit 12 is formed by laminating, from the above, an upper end plate cover 170T having a dome-shaped bulge, the upper end plate 160T, the upper cylinder 121T, an intermediate partition plate 140, the lower cylinder 121S, the lower end plate 160S, and a flat plate-shaped lower end plate cover 170S. The compression unit 12 is fixed by pluralities of through bolts 174 and 175 and auxiliary bolts 176, which are arranged substantially concentrically from above and below.

The annular upper cylinder 121T is provided with an upper suction hole 135T that fits to the upper suction pipe 105. The annular lower cylinder 121S is provided with a lower suction hole 135S that fits to the lower suction pipe 104. Further, the upper piston 125T is disposed in an upper cylinder chamber 130T of the upper cylinder 121T. A lower piston 125S is disposed in a lower cylinder chamber 130S of the lower cylinder 121S.

The upper cylinder 121T is provided with an upper vane groove 128T that extends outward radially from the upper cylinder chamber 130T, and an upper vane 127T is disposed in the upper vane groove 128T. The lower cylinder 121S is provided with a lower vane groove 128S that extends outward radially from the lower cylinder chamber 130S, and a lower vane 127S is disposed in the lower vane groove 128S.

The upper cylinder 121T is provided, from an outer side surface thereof, with an upper spring hole 124T at a position that overlaps the upper vane groove 128T at a depth at which the upper spring hole 124T does not penetrate the upper cylinder chamber 130T, and an upper spring 126T is disposed in the upper spring hole 124T. The lower cylinder 121S is provided, from an outer side surface thereof, with a lower spring hole 124S at a position that overlaps the lower vane groove 128S at a depth at which the lower spring hole 124S does not penetrate the lower cylinder chamber 130S, and a lower spring 126S is disposed in the lower spring hole 124S.

The upper cylinder chamber 130T is closed with the upper end plate 160T on an upper side thereof and with the intermediate partition plate 140 on a lower side thereof. The lower cylinder chamber 130S is closed with the intermediate partition plate 140 on an upper side thereof and with the lower end plate 160S on a lower side thereof.

The upper vane 127T is pressed by the upper spring 126T and abuts against an outer circumferential surface of the upper piston 125T, whereby the upper cylinder chamber 130T is divided into the upper suction chamber 131T to which the upper suction hole 135T is coupled and an upper compression chamber 133T to which an upper discharge hole 190T provided in the upper end plate 160T is coupled. The lower vane 127S is pressed by the lower spring 126S and abuts against an outer circumferential surface of the lower piston 125S, whereby the lower cylinder chamber 130S is divided into the lower suction chamber 131S to which the lower suction hole 135S is coupled and a lower compression chamber 133S to which a lower discharge hole 190S provided in the lower end plate 160S is coupled.

The upper end plate 160T is provided with the upper discharge hole 190T that penetrates the upper end plate 160T and communicates with the upper compression chamber 133T of the upper cylinder 121T, and on an outlet side of the upper discharge hole 190T, an annular upper valve seat, (not illustrated) that surrounds the upper discharge hole 190T is formed. On the upper end plate 160T, an upper discharge valve accommodating recess 164T is formed, which extends in a groove shape from a position of the upper discharge hole 190T toward an outer circumference of the upper end plate 160T.

The upper discharge valve accommodating recess 164T accommodates the entirety of a lead valve-type upper discharge valve 200T and an upper discharge valve retainer 201T. A rear end of the upper discharge valve 200T is fixed into the upper discharge valve accommodating recess 164T by an upper rivet 202T, and the upper discharge valve 200T opens and closes the upper discharge hole 190T in such a manner that a front portion thereof moves up and down in a state in which such a rear portion is fixed. In the upper discharge valve retainer 201T, a rear end thereof is overlapped with the upper discharge valve 200T, and is fixed into the upper discharge valve accommodating recess 164T by the upper rivet 202T, and a front portion thereof is curved (warped) in a direction in which the upper discharge valve 200T opens, and regulates an opening of the upper discharge valve 200T.

The lower end plate 1603 is provided with a lower discharge hole 190S that penetrates the lower end plate 160S and communicates with the lower compression chamber 133S of the lower cylinder 121S. Then, on an outlet side of the lower discharge hole 190S of the lower end plate 160S, an annular lower valve seat that surrounds the lower discharge hole 190S is formed. On the lower end plate 160S, a lower discharge valve accommodating recess is formed, which extends in a groove shape from a position of the lower discharge hole 190S toward an outer circumference of the lower end plate 160S.

A lower discharge valve accommodating recess 164S accommodates the whole of a lead valve-type lower discharge valve 200S and a lower discharge valve retainer 201S. A rear end of the lower discharge valve 200S is fixed into the lower discharge valve accommodating recess 164S by a lower rivet 202S, and a front portion thereof opens and closes the lower discharge hole 190S in such a manner that the front portion moves up and down in a state in which such a rear portion is fixed. In the lower discharge valve retainer 201S, a rear end thereof is overlapped with the lower discharge valve 200S, and is fixed into the lower discharge valve accommodating recess 164S by the lower rivet 202S, and a front portion thereof is curved (warped) in a direction in which the lower discharge valve 200S opens, and regulates an opening of the lower discharge valve 200S.

An upper end plate cover chamber 180T is formed between the upper end plate 160T and the upper end plate cover 170T having the dome-shaped bulge, which are fixed so as to be in close contact with each other. A lower end plate cover chamber 180S is formed between the lower end plate 160S and the flat plate-shaped lower end plate cover 170S, which are fixed so as to be in close contact with each other. A refrigerant passage hole 136 is provided, which penetrates the lower end plate 160S, the lower cylinder 121S, the intermediate partition plate 140, the upper end plate 160T, and the upper cylinder 121T, and causes the lower end plate cover chamber 180S and the upper end plate cover chamber 130T to communicate with each other.

Shaft 15

Figure 3:
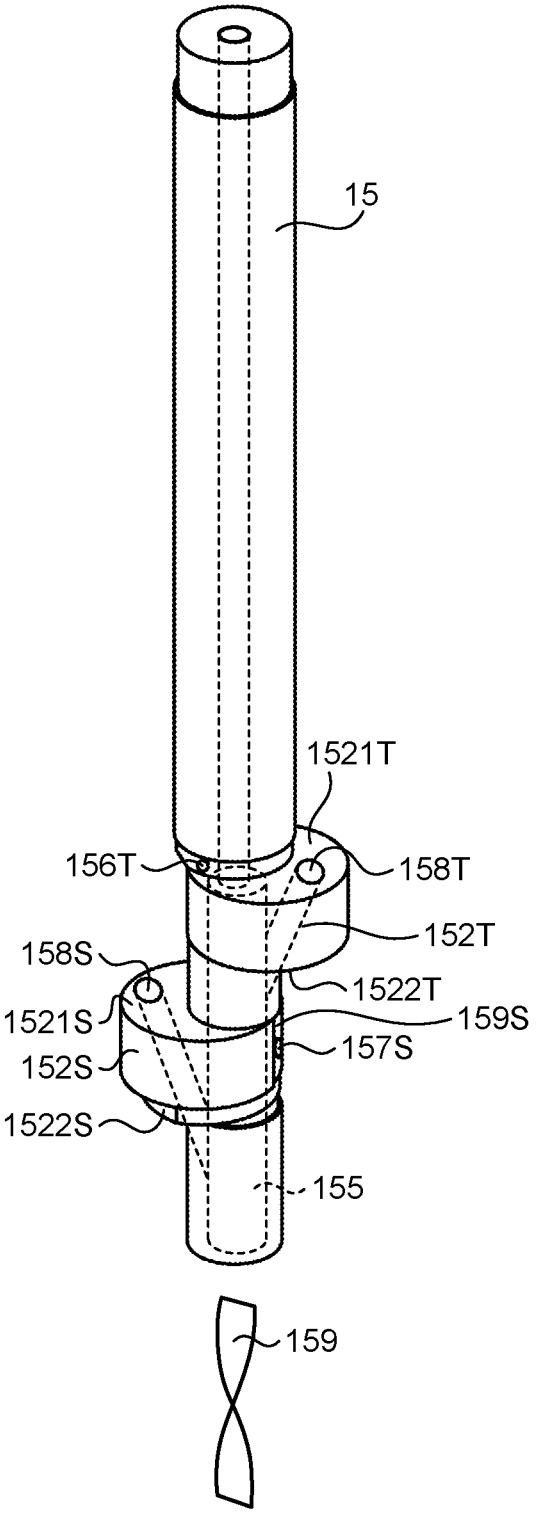
FIG. 3 is a perspective view of a shaft of the rotary compressor of the first embodiment.
Figure 4:
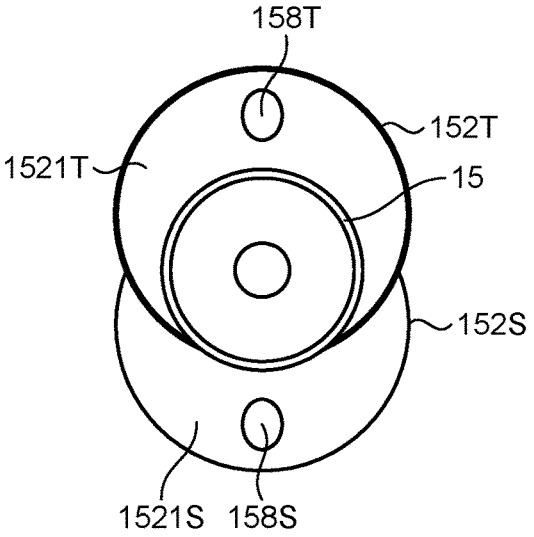
FIG. 4 is a plan view of the shaft of the rotary compressor of the first embodiment.
Figure 5:
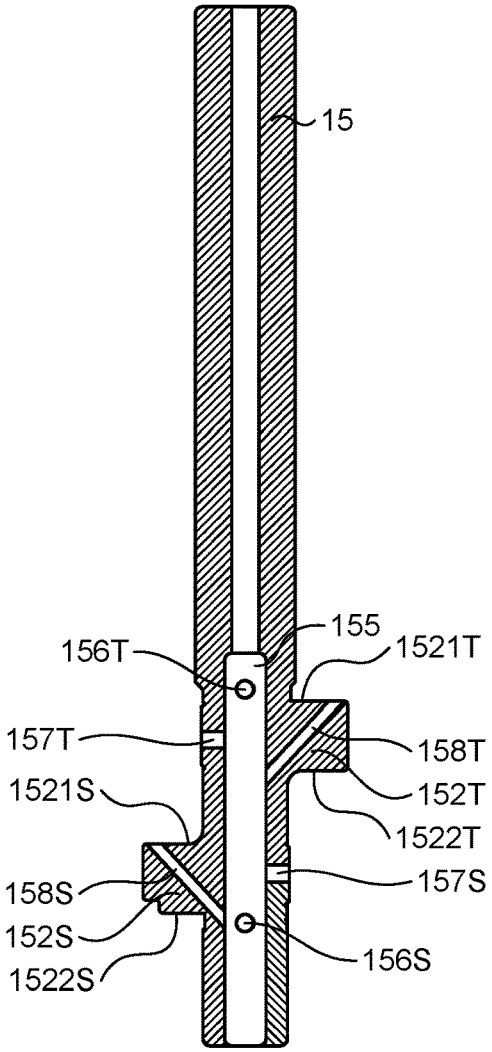
FIG. 5 is a view for explaining a through hole for oil supply, which is provided in the shaft of the rotary compressor of the first embodiment.

Next, a description will be given of a configuration of the characteristic shaft 15 of the rotary compressor 1 of the first embodiment. FIG. 3 is a perspective view of the shaft of the rotary compressor of the first embodiment. Further, FIG. 4 is a plan view of the shaft of the rotary compressor of the first embodiment. Moreover, FIG. 5 is a view for explaining a through hole for oil supply, which is provided in the shaft of the rotary compressor of the first embodiment. Hereinafter, a central axis when the shaft 15 rotates will be referred to as a rotation axis of the shaft 15.

As illustrated in FIGS. 3 and 5, the shaft 15 includes: a hollow portion 155 that opens on a lower end side; and a gas vent hole that has an opening on an upper end side and connects to the hollow portion 155 on a lower end side to cause the hollow portion 155 and a space above the shaft 15 to communicate with each other. Then, an oil supply blade 159 illustrated in FIG. 3 is press-fitted into the hollow portion 155.

Further, as illustrated in FIGS. 3 and 5, the shaft 15 is provided with an oil supply horizontal hole 156T that has an opening at a spot located above an upper end surface 1521T of the upper eccentric portion 152T on a side surface of the shaft 15 and is coupled to the hollow portion 155. Further, as illustrated in FIG. 5, the shaft 15 is provided with an oil supply horizontal hole 156S that has an opening at a spot located below a lower end surface 1522S of the lower eccentric portion 152S on the side surface of the shaft 15 and is coupled to the hollow portion 155.

Moreover, the shaft 15 is provided with an oil supply horizontal hole 157T that has an opening at a spot on the side surface of the shaft 15, the spot facing the upper eccentric portion 152T with the hollow portion 155 sandwiched therebetween, and is coupled to the hollow portion 155. Further, the shaft 15 is provided with an oil supply horizontal hole 157S that has an opening at a spot on the side surface of the shaft 15, the spot facing the lower eccentric portion 152S with the hollow portion 155 sandwiched therebetween, and is coupled to the hollow portion 155. The oil supply horizontal hole 157T is provided below the oil supply horizontal hole 156T. Further, the oil supply horizontal hole 156S is provided below the oil supply horizontal hole 157S. Then, the oil supply horizontal holes 157T and 157S are provided at positions opposite to each other with the shaft 15 sandwiched therebetween.

Further, the shaft 15 is provided with an oil supply diagonal hole 158T that has an opening on the upper end surface 1521T of the upper eccentric portion 152T and penetrates the upper eccentric portion 152T to be coupled to the hollow portion 155. The oil supply diagonal hole 158T is a route that connects the opening provided on the upper end surface 1521T of the upper eccentric portion 152T and an opening provided on the hollow portion 155 to each other, and is a route inclined with respect to the hollow portion 155. In other words, the oil supply diagonal hole 158T is a route that connects the opening provided on the upper end surface 1521T of the upper eccentric portion 152T and the opening provided on the hollow portion 155 to each other, and is a route inclined with respect to the rotation axis of the shaft 15. Here, a hole having an inclination with respect to the rotation axis is referred to as a "diagonal hole". As illustrated in FIG. 4, the opening of the oil supply diagonal hole 158T on the upper end surface 1521T is disposed in the vicinity of an outer circumferential end portion of the upper end surface 1521T of the upper eccentric portion 152T. Here, the opening of the oil supply diagonal hole 158T may be provided anywhere on the upper end surface 1521T of the upper eccentric portion 152T, but is preferably provided in the vicinity of the outer circumference of the upper end surface 1521T in an eccentric direction. Here, the eccentric direction of the upper end surface 1521T is a radial direction of the rotation axis of the shaft 15 and a direction in which an outer wall of the upper eccentric portion 152T is present at a position farthest from the shaft 15. Then, as illustrated in FIG. 5, the opening of the oil supply diagonal hole 158T, which is located in the vicinity of the hollow portion 155, is provided at a position below a lower end surface 1522T of the upper eccentric portion 152T.

Further, the shaft 15 is provided with an oil supply diagonal hole 158S that has an opening on an upper end surface 1521S of the lower eccentric portion 152S and penetrates the lower eccentric portion 152S to be coupled to the hollow portion 155. The oil supply diagonal hole 158S is a route that connects the opening provided on the upper end surface 1521S of the lower eccentric portion 152S and an opening provided on the hollow portion 155 to each other, and is a route inclined with respect to the hollow portion 155. In other words, the oil supply diagonal hole 158S is a route that connects the opening provided on the upper end surface 1521S of the lower eccentric portion 152S and the opening provided on the hollow portion 155 to each other, and is a route inclined with respect to the rotation axis of the shaft 15. As illustrated in FIG. 4, the opening of the oil supply diagonal hole 158S on the upper end surface 1521S is disposed in the vicinity of an outer circumferential end portion of the upper end surface 1521S of the lower eccentric portion 152S. Here, the opening of the oil supply diagonal hole 158S may be provided anywhere on the upper end surface 1521S of the lower eccentric portion 152S, but is preferably provided in the vicinity of the outer circumference of the upper end surface 1521S in an eccentric direction. Here, the eccentric direction of the upper end surface 1521T is a radial direction of the rotation axis of the shaft 15 and a direction in which an outer wall of the lower eccentric portion 152S is present at a position farthest from the shaft 15. Then, as illustrated in FIG. 5, the opening of the oil supply diagonal hole 158S, which is located in the vicinity of the hollow portion 155, is provided at a position below a lower end surface 1522S of the lower eccentric portion 152S.

Figure 6:
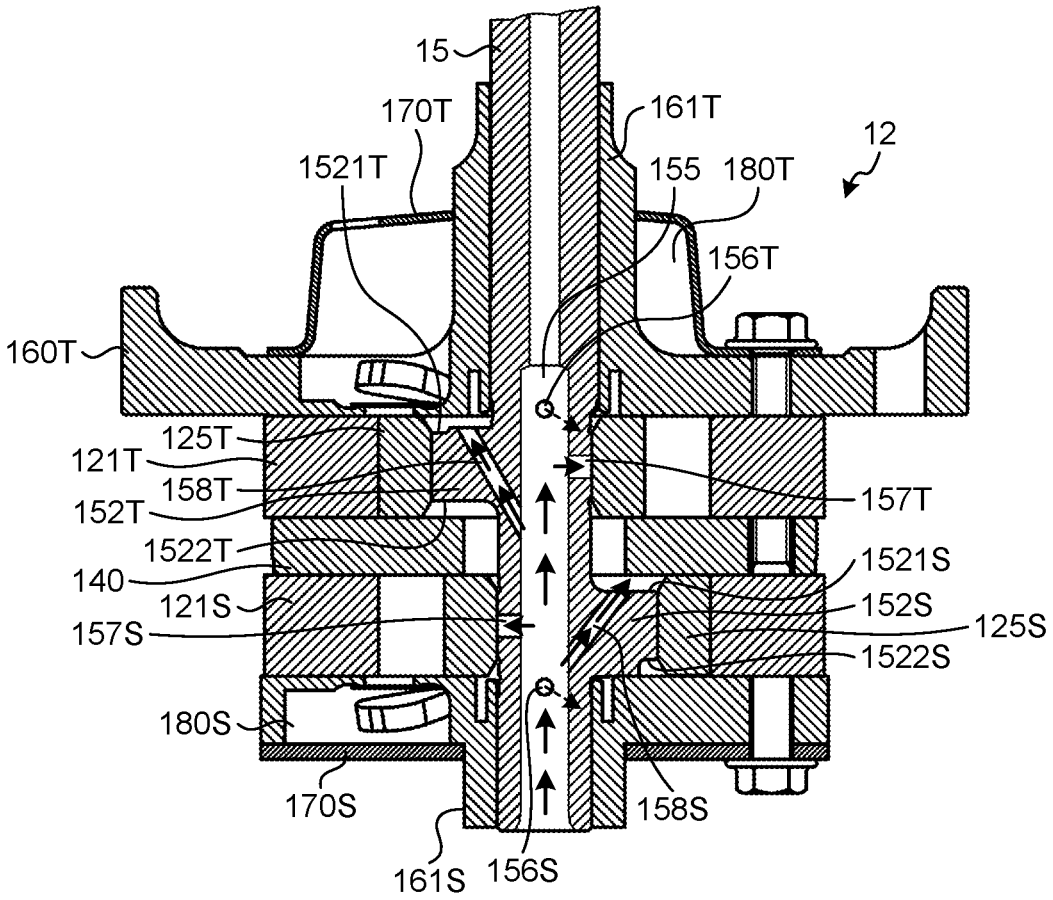
FIG. 6 is a view illustrating a supply route of lubricating oil in the compressor.

Here, referring to FIG. 6, a flow of the lubricating oil 18 will be described. FIG. 6 is a view illustrating a supply route of the lubricating oil in the compressor. In FIG. 6, the flow of the lubricating oil 18 is indicated by arrows.

The lubricating oil 18 in the hollow portion 155 of the shaft 15 is discharged to the outside of the shaft 15 through the oil supply horizontal holes 156S, 157S, 156T and 157T and the oil supply diagonal holes 158S and 158T by the centrifugal force that acts by the rotation of the shaft 15. The oil supply horizontal holes 156T and 156S are provided in the same direction with respect to the rotation axis of the shaft 15. The oil supply horizontal holes 157T and the oil supply horizontal holes 157S are provided in the directions opposite to each other with respect to the rotation axis of the shaft 15. Then, the oil supply horizontal hole 156T is provided at a position higher than that of the oil supply horizontal hole 157T. Further, the oil supply horizontal hole 156S is provided at a position lower than that of the oil supply horizontal hole 156S.

The positions of the openings of the oil supply diagonal holes 158S and 158T, which discharge the lubricating oil 18, are farther than those of the oil supply horizontal holes 156S, 157S, 156T and 157T in the radial direction of the rotation axis of the shaft 15. Therefore, the lubricating oil 18 discharged from the oil supply diagonal holes 158S and 158T receives a stronger centrifugal force than for the lubricating oil 18 discharged from the oil supply horizontal holes 156S, 157S, 156T and 157T. Thus, in the oil supply diagonal holes 158S and 158T, the lubricating oil 18 is pushed in directions away from the shaft 15 with a stronger force than for the oil supply horizontal holes 156S, 157S, 156T and 157T, and is discharged more. The lubricating oil 18 is discharged more, whereby the lubricating oil 18 is sufficiently distributed to the ends of the upper eccentric portion 152T and the lower eccentric portion 152S, and spaces outside the upper eccentric portion 152T and the lower eccentric portion 152S can be filled with the lubricating oil 18.

Then, the lubricating oil 18 discharged to the outside from the respective openings are supplied to sliding surfaces of the auxiliary bearing portion 161S and the auxiliary shaft portion 151 of the shaft 15, sliding surfaces of the main bearing portion 161T and the main shaft portion 153 of the shaft 15, sliding surfaces of the lower eccentric portion 152S of the shaft 15 and the lower piston 125S, and sliding surfaces of the upper eccentric portion 152T and the upper piston 125T, and lubricates the respective sliding surfaces.

In particular, the lubricating oil 18 discharged from the oil supply diagonal hole 158S spreads to the upper end surface 1521S of the lower eccentric portion 152S, and is carried to an outer circumferential portion of the lower eccentric portion 152S in the eccentric direction by the centrifugal force. Then, the lubricating oil 18 carried to the vicinity of such an outer circumference of the lower eccentric portion 152S is supplied to an upper end surface of the lower piston 125S. Further, the lubricating oil 18 supplied to the upper end surface 1521S is supplied to a lower end surface of the lower piston 125S by moving downward by gravity through a groove 159S that vertically penetrates a part of the outer circumferential surface of the lower eccentric portion.

Likewise, the lubricating oil 18 discharged from the oil supply diagonal hole 158T spreads to the upper end surface 1521T of the upper eccentric portion 152T, and is carried to an outer circumferential portion of the upper eccentric portion 152T in the eccentric direction by the centrifugal force. Then, the lubricating oil 18 carried to the vicinity of such an outer circumference of the upper eccentric portion 152T is supplied to an upper end surface of the upper piston 125T. Further, the lubricating oil 18 supplied to the upper end surface 1521T is supplied to a lower end surface of the upper piston 125T by moving downward by the gravity through a groove (not illustrated) that vertically penetrates a part of the outer circumferential surface of the upper eccentric portion.

The oil supply blade 159 is held by the hollow portion 155 of the shaft 15, and rotates as the shaft 15 rotates to press the lubricating oil 18 against an inner wall of the hollow portion 155. Thus, the lubricating oil 18 becomes easy to receive the centrifugal force due to the rotation of the hollow portion 155, and the hollow portion 155 becomes easy to pump up the lubricating oil 18. The oil supply blade 159 also plays a role of supplying the lubricating oil 18 to the above-described sliding surfaces even when the lubricating oil 18 is discharged from the compressor housing 10 together with the refrigerant and the oil level becomes low.

Figure 7:
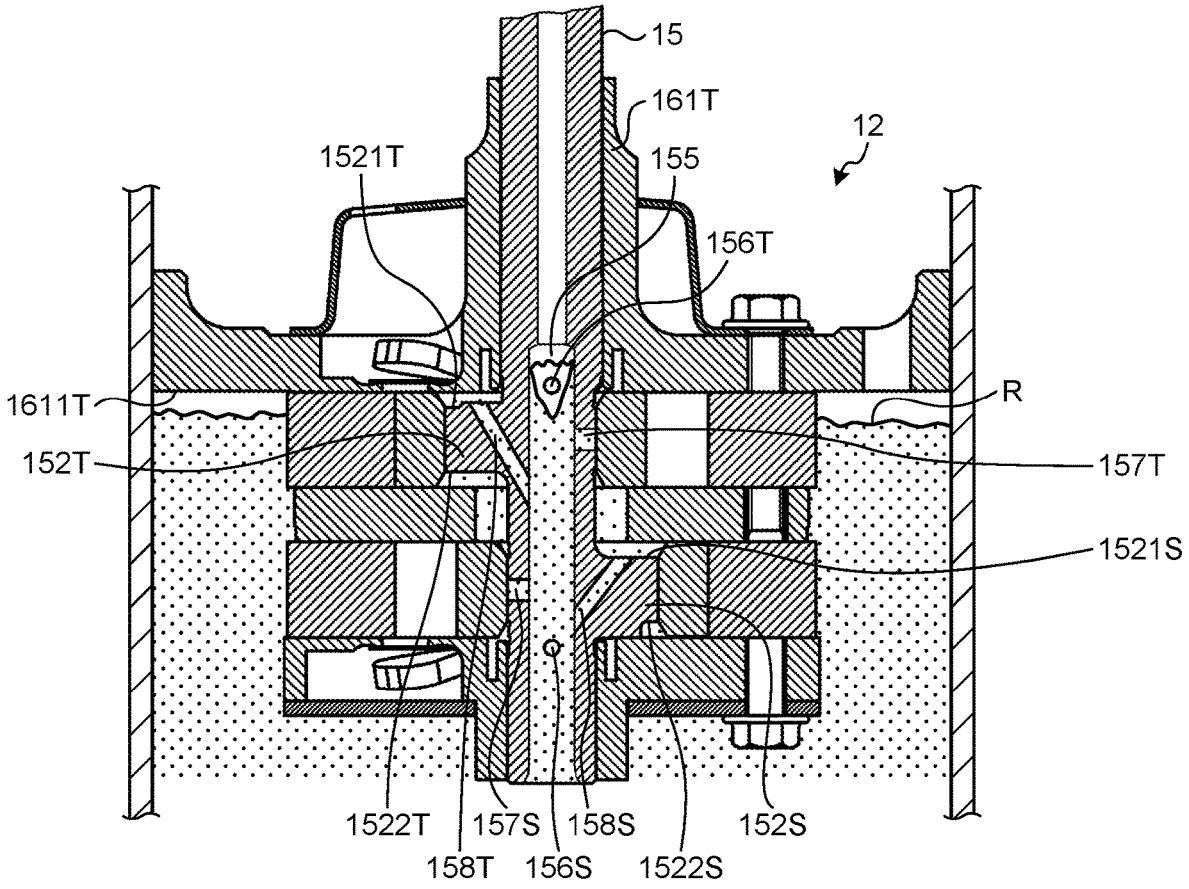
FIG. 7 is a view illustrating a state of a normal oil level.
Figure 8:
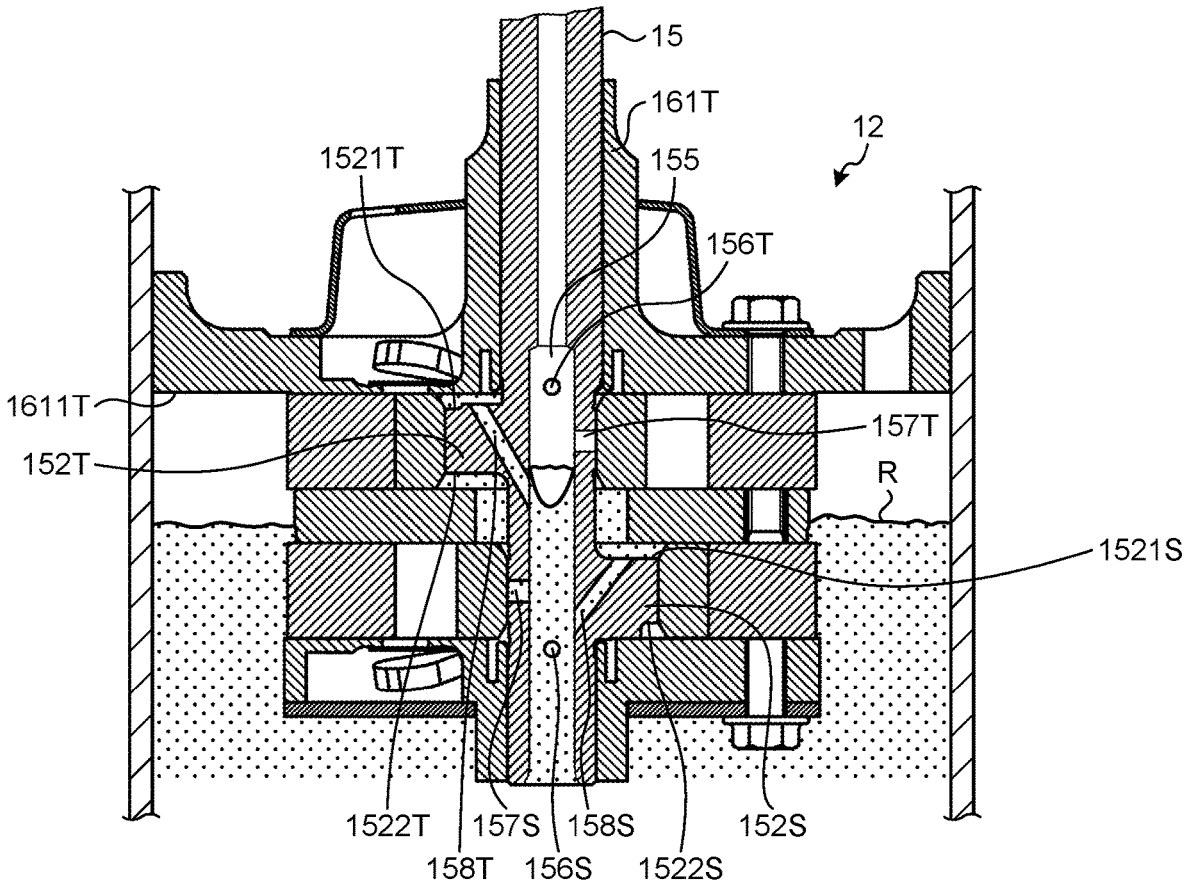
FIG. 8 is a view illustrating a state of a lowered oil level.

Here, FIG. 7 is a view illustrating a state of a normal oil level when the compressor is operated at a low rotation speed. Further, FIG. 8 is a view illustrating a state of the oil level temporarily lowered at the time of starting, or the like. In FIGS. 7 and 8, a dot pattern represents the lubricating oil 18. Moreover, an oil level R represents a liquid level of the lubricating oil. Here, the normal state of the oil level is a state of the oil level when the lubricating oil 18 is not discharged from the inside of the compressor housing 10 and a sufficient amount of the lubricating oil 18 is present therein. Further, the time when the compressor is operated at a low rotation speed corresponds, for example, to the time when the rotary compressor 1 operates in a state in which pressures of the upper suction chamber 131T and the lower suction chamber 131S are low.

If a discharge amount of the lubricating oil 18 discharged from the inside of the compressor housing 10 to the outside thereof is small, and a height of the oil level R is normal, then even if the rotation speed of the shaft 15 is low, the height of the oil level of the lubricating oil 18 that goes along an inner wall surface of the hollow portion 155 is higher than that of a lower end portion 1611T of the main bearing portion 161T as illustrated in FIG. 7, and the oil supply horizontal holes 156T and 157T and the oil supply diagonal hole 158T are filled with the lubricating oil 18. Here, downward parabolas representing the oil level R of the lubricating oil 18 inside the hollow portion 155 in FIG. 7 represent a state of a capillary phenomenon due to surface tension of the lubricating oil 18. Further, a line that connects the downward parabolas representing the oil level R of the lubricating oil 18 to each other represents the oil level R of the lubricating oil 18 that rises along a wall of the shaft 15 on a back side when facing FIG. 7. In this case, if the oil level R is normal, the lubricating oil 18 is supplied to the outside of the shaft 15 individually from the oil supply horizontal holes 156T and 157T and the oil supply diagonal hole 158T.

On the other hand, if the discharge amount of the lubricating oil 18 is large and the oil level is lowered, then as illustrated in FIG. 8, the oil level R of the lubricating oil 18 may be lowered more than the lower end surface 1522T of the upper eccentric portion 152T. If the rotation speed of the shaft 15 is high even if the oil level R is lowered, then a highest point of the lubricating oil 18 that goes along the inner wall surface of the hollow portion 155 becomes high due to the centrifugal force. However, if the rotation speed of the shaft 15 is low, then the highest point of the lubricating oil 18 becomes low as illustrated in the hollow portion 155 of FIG. 8, and the lubricating oil 18 does not reach the openings of the oil supply horizontal holes 156T and 157T, which are located in the vicinity of the hollow portion 155. Here, downward parabolas representing the oil level R of the lubricating oil 18 inside the hollow portion 155 in FIG. 8 represent a state of a capillary phenomenon due to surface tension of the lubricating oil 18. Further, a line that connects the downward parabolas representing the oil level R of the lubricating oil 18 to each other represents the oil level R of the lubricating oil 18 that rises along a wall of the shaft 15 on a back side when facing FIG. 8. In this case, the lubricating oil 18 is not supplied to the outside of the shaft 15 from the oil supply horizontal holes 156T and 157T.

On the other hand, the opening of the oil supply diagonal hole 158T, which is located in the vicinity of the hollow portion 155, is located below the lower end surface 1522T of the upper eccentric portion 152T. Therefore, even in the state in which the oil level R of the lubricating oil 18 is lowered, the lubricating oil 18 reaches the opening of the oil supply diagonal hole 158T, which is located in the vicinity of the hollow portion 155. Hence, the lubricating oil 18 is discharged from the oil supply diagonal hole 158T. In this way, even if the oil level becomes low, the oil supply to the lower end portion 1611T of the main bearing portion 161T, the upper eccentric portion 152T and the upper piston 125T can be ensured.

Next, a flow of the refrigerant by the rotation of the shaft 15 will be described. In the upper cylinder chamber 130T, the upper piston 125T fitted to the upper eccentric portion 152T of the shaft 15 revolves along the inner circumferential surface of the upper cylinder 121T by the rotation of the shaft 15, whereby the upper suction chamber 131T sucks the refrigerant from the upper suction pipe 105 while expanding a volume thereof, the upper compression chamber 133T compresses the refrigerant while reducing a volume thereof, and when a pressure of the compressed refrigerant becomes higher than a pressure of the upper end plate cover chamber 180T on the outside of the upper discharge valve 200T, the upper discharge valve 200T opens, and the refrigerant is discharged from the upper compression chamber 133T to the upper end plate cover chamber 180T. The refrigerant discharged into the upper end plate cover chamber 180T is discharged into the compressor housing 10 from an upper end plate cover discharge hole 172T (see FIG. 1) provided on the upper end plate cover 170T.

Further, in the lower cylinder chamber 130S, the lower piston 125S fitted to the lower eccentric portion 152S of the shaft 15 revolves along the inner circumferential surface of the lower cylinder 121S by the rotation of the shaft 15, whereby the lower suction chamber 131S sucks the refrigerant from the lower suction pipe 104 while expanding a volume thereof, the lower compression chamber 133S compresses the refrigerant while reducing a volume thereof, and when a pressure of the compressed refrigerant becomes higher than a pressure of the lower end plate cover chamber 180S on the outside of the lower discharge valve 200S, the lower discharge valve 200S opens, and the refrigerant is discharged from the lower compression chamber 133S to the lower end plate cover chamber 180S. The refrigerant discharged into the lower end plate cover chamber 180S passes through the refrigerant passage hole 136 and the upper end plate cover chamber 180T and is discharged into the compressor housing 10 from the upper end plate cover discharge hole 172T (see FIG. 1) provided on the upper end plate cover 170T.

The refrigerant discharged into the compressor housing 10 passes through a cutout (not illustrated) that is provided on an outer circumference of the stator 111 and causes upper and lower ends thereof to communicate with each other, gaps (not illustrated) in a winding portion of the stator 111, or a gap 115 (see FIG. 1) between the stator 111 and the rotor 112, is guided above the motor unit 11, and is discharged from the discharge pipe 107 on the upper portion of the compressor housing 10.

According to the rotary compressor 1 of the first embodiment, which is described above, the shaft 15 is provided with, as mentioned above, the oil supply diagonal hole 158T that causes the position below the lower end surface 1522T of the upper eccentric portion 152T in the hollow portion 155 and the upper end surface 1521T of the upper eccentric portion 152T to communicate with each other. Thus, even if the oil level becomes low, the lubricating oil 18 can be supplied to the upper end surface 1521T of the upper eccentric portion 152T using the oil supply diagonal hole 158T, and the oil supply to the lower end portion 1611T of the main bearing portion 161T, the upper eccentric portion 152T and the upper piston 125T can be ensured.

Further, the oil supply diagonal holes 158T and 158S may be provided one by one in the upper eccentric portion 152T and the lower eccentric portion 152S, and further, each thereof may be one linear hole. That is, when the oil supply diagonal holes 158T and 158S are provided, it is easy to machine the shaft 15.

Hence, it becomes possible to strengthen a centrifugal pumping action by rotating the shaft while suppressing the increase in cost due to complicated machining and an increase in the amount of filled oil. Then, the inner circumferential surfaces of the main bearing, the auxiliary bearing, and the piston which are the sliding portions are lubricated, and further, the minute gaps between the plurality of parts which form the suction chamber and the compression chamber are sealed by the oil, whereby the degradation of the reliability of the compressor and the degradation of the performance thereof can be prevented.

Modified Example

Further, in the above-mentioned embodiment, the upper end surface 1521T and the upper end surface 1521S are provided with the openings of the oil supply diagonal holes 158T and 158S, but inclined surfaces made by cutting the ends of the upper eccentric portion 152T and the lower eccentric portion 152S may be provided with the openings of the oil supply diagonal holes 158T and 158S.

The inclined surfaces provided on the upper eccentric portion 152T and the lower eccentric portion 152S face the hollow portion 155, and the respective inclined surfaces are machined by bringing a drill into perpendicular contact with the same, whereby the oil supply diagonal holes 158T and 158S can be formed. Thus, the drill can be prevented from escaping when the shaft 15 is machined, and it becomes easier to machine the same.

Further, in the embodiment, six holes which are the oil supply horizontal holes 156T, 156S, 157T and 157S, and the oil supply diagonal holes 158T and 158S are provided as through holes which cause the hollow portion 155 and the outside of the shaft 15 to communicate with each other, but the arrangement of the through holes is not limited to this.

For example, if a sufficient amount of the oil supply can be ensured only by the oil supply diagonal hole 158T, any or all of the oil supply horizontal holes 156T, 156S, 157T and 157S and the oil supply diagonal hole 158S do not have to be provided.

Further, in the above-mentioned embodiment, the two cylinder-type rotary compressor 1 has been described as an example, but one cylinder-type rotary compressor may be used. By providing the oil supply diagonal hole in a shaft of the one cylinder-type, the supply of the lubricating oil 18 and the increase of the supply amount of the lubricating oil 18 when conditions for lowering the rising position of the lubricating oil 18 overlap one another can be achieved. That is, the reliability of the shaft 15 and the compressor performance of the rotary compressor 1 can be enhanced by easy machining.

Although the embodiments and the modified example have been described above, the embodiments and the modified example are not limited by the contents mentioned above. Further, the above-mentioned constituents include those which can be assumed by those skilled in the art, those which are substantially the same, that is, those in the so-called equilibrium range. Further, it is possible to combine the above-mentioned constituents with one another as appropriate. Moreover, at least one of various omissions, substitutions and changes of the constituents may be made without departing from the spirit of the embodiments.

REFERENCE SIGNS LIST

1 ROTARY COMPRESSOR
10 COMPRESSOR HOUSING
11 MOTOR UNIT
12 COMPRESSION UNIT
15 SHAFT
18 LUBRICATING OIL
151 AUXILIARY SHAFT PORTION
152T UPPER ECCENTRIC PORTION
152S LOWER ECCENTRIC PORTION
153 MAIN SHAFT PORTION
155 HOLLOW PORTION
156T, 156S, 157T, 157S OIL SUPPLY HORIZONTAL HOLE
158T, 158S OIL SUPPLY DIAGONAL HOLE
159 OIL SUPPLY BLADE
1521T, 1521S UPPER END SURFACE
1522T, 1522S LOWER END SURFACE

The invention claimed is:

1. A rotary compressor comprising:
a vertical cylindrical hermetically sealed container;
a motor and a compressor which are provided inside the vertical cylindrical hermetically sealed container, the compressor being disposed below the motor; and
lubricating oil of which amount causes immersion of a part of the compressor is stored in the hermetically sealed container,
wherein the compressor includes
a shaft having a first eccentric portion and a second eccentric portion that are aligned in a direction in which a rotation axis of the shaft extends,
a piston shaped to fit into the eccentric portion,
a flat plate-shaped vane pressed against an outer circumferential surface of the piston, and
a cylinder that accommodates the piston and the vane and forms a suction chamber and a compression chamber,
wherein a hollow portion is provided on a lower end side of the shaft, and
wherein the shaft
has a first oil supply diagonal hole that is inclined with respect to the rotation axis of the shaft,
has an opening in the hollow portion at a position between the first eccentric portion and the second eccentric portion and causes the hollow portion and an upper end of the first eccentric portion located in a vicinity of the motor to communicate with each other, and
has an oil supply horizontal hole that causes the hollow portion and a side surface of the shaft to communicate with each other.

2. The rotary compressor according to claim 1, wherein the shaft has a second oil supply diagonal hole that is inclined with respect to the rotation axis of the shaft, has an opening in the hollow portion at a position below a lower end surface of the second eccentric portion, and causes the hollow portion and an upper end of the second eccentric portion to communicate with each other.

* * * * *